United States Patent [19]

Kuroiwa et al.

[11] 4,132,199

[45] Jan. 2, 1979

[54] AIR-FUEL RATIO CONTROL APPARATUS

[75] Inventors: Hiroshi Kuroiwa, Hitachi; Yutaka Nishimura; Yoshishige Ohyama, both of Katsuta; Torazo Nishimiya, Mito, all of Japan

[73] Assignee: Hitachi, Ltd., Japan

[21] Appl. No.: 814,623

[22] Filed: Jul. 11, 1977

[30] Foreign Application Priority Data

Jul. 12, 1976 [JP] Japan ..... 51-81907

[51] Int. Cl.[2] ..... F02B 33/00

[52] U.S. Cl. ..... 123/119 EC; 123/32 EE; 123/119 D; 123/32 EA; 60/276; 60/285; 261/67

[58] Field of Search ..... 123/119 EE, 32 EE, 32 EA, 123/119 D, 127; 60/276; 261/121 B, 67

[56] References Cited

U.S. PATENT DOCUMENTS

| | | | |
|---|---|---|---|
| 2,423,589 | 7/1947 | Ericson | 123/127 |
| 3,827,237 | 8/1974 | Linder et al. | 123/32 EE |
| 3,906,910 | 9/1975 | Szlaga, Jr. | 123/119 EC |
| 3,933,951 | 1/1976 | Fischer et al. | 261/121 B |
| 4,023,357 | 5/1977 | Masaki | 123/119 EC |
| 4,026,256 | 5/1977 | Fenn | 123/119 EC |
| 4,030,292 | 6/1977 | Masaki et al. | 123/119 EC |
| 4,046,118 | 9/1977 | Aono | 123/119 EC |
| 4,046,120 | 9/1977 | Laprade et al. | 123/119 EC |
| 4,057,042 | 11/1977 | Aono | 123/119 EC |
| 4,061,118 | 12/1977 | Kiyota | 123/119 EC |

*Primary Examiner*—Charles J. Myhre
*Assistant Examiner*—R. A. Nelli
*Attorney, Agent, or Firm*—Craig & Antonelli

[57] ABSTRACT

An air-fuel ratio control apparatus for use in a motor vehicle having an internal combustion engine provided with a carburetor including a main fuel supply system and a low speed fuel supply system for supplying fuel to the engine. The apparatus includes an electromagnetic valve for controlling the volume of air flowing through the air bleed of the main fuel supply system, an electromagnetic valve for controlling the volume of air flowing through the air bleed of the low speed fuel supply system, an $O_2$ sensor for detecting the concentration of $O_2$ in exhaust emissions, and a control circuit for producing as an output a control signal in accordance with a signal from the $O_2$ sensor. The two electromagnetic valves are controlled by the same signal from the control circuit. A plurality of microswitches for detecting the starting of the engine, high speed operation of the engine and power operation of the engine respectively are provides so as to disconnect the control circuit from the electromagnetic valves.

15 Claims, 10 Drawing Figures

| SYMBOL | DIA. OF ORIFICE OF LOW CONTROL AIR BLEED | DIA. OF ORIFICE OF MAIN CONTROL AIR BLEED |
|---|---|---|
| ⊙ | 1.2 mm | 1.6 mm |
| • | 0 | 0 |
| × | 1.5 mm | 2.5 mm |
| △ | 1.5 mm | 1.6 mm |
| ▽ | 0 | 1.6 mm |
| □ | 1.2 mm | 2.5 mm |
| + | 1.2 mm | 0 |

AIR-FUEL RATIO CONTROL APPARATUS

BACKGROUND OF THE INVENTION

This invention relates to an air-fuel ratio control apparatus operative to automatically effect control of the air-fuel ratio of fuel-air mixtures supplied from a carburetor to a gasoline engine in such a manner that the ratio can be automatically brought to a predetermined level.

In order to avoid the problem of air polution by exhaust emissions of internal combustion engines, it is desired that the air-fuel ratios of fuel-air mixtures supplied to the internal combustion engines be kept constant. Particularly when a motor vehicle uses an exhaust emission control system in which a so-called ternary catalyst is employed for oxidating carbon monoxide and hydrocarbons and at the same time reducing oxides of nitrogen by means of the single catalyst, the air-fuel ratio of the fuel-air mixtures supplied to the engine is preferably maintained in a narrow range or in a range of values which is ±0.2 of the theoretical air-fuel ratio, for example. This is because, if the air-fuel ratios are confined to the indicated range, the carbon monoxide, hydrocarbons and oxides of nitrogen in the exhaust emissions will all be controlled at a percentage of over 90% by means of a ternary catalyst, and thus the ternary catalyst can achieve excellent results in exhaust emission control.

However, in carburetors currently used in motor vehicles, a great difficulty is encountered in restricting the changes in the air-fuel ratio to a narrow range of values slightly greater and smaller than the theoretical air-fuel ratio, while the engine is operating at normal engine speeds.

To cope with this situation, proposals have been made to use air-fuel ratio control apparatus of the feedback system which detect the concentration of exhaust gases from the engine and effect control of the air-fuel ratio of fuel-air mixtures supplied to the engine in conformity with a detection signal. Such apparatus are disclosed, for example, in U.S. Pat. Nos. 3,942,493, 3,960,118, Japanese Laid-Open Patent Publication Nos. 54131/76 and 20654/76.

In one type of air-fuel ratio control apparatus of the feedback system known in the art, electronic fuel injecting means is used which detects the concentration of oxygen in exhaust gases and injects fuel into the air introduced into the engine, in such a manner that the volume of the injected fuel is determined by the detected concentration of oxygen. This type of apparatus can achieve good effects in controlling the volume of the fuel injected into the air, but has the disadvantage of greatly increased in production cost as compared with conventional carburetors of the fixed Venturi type.

Another type of air-fuel ratio control apparatus of the feedback system known in the art, which is used with a carburetor of the fixed Venturi type, operates in a manner to control the volume of fuel supplied to the carburetor of the fixed Venturi type in accordance with the concentration of oxygen in the exhaust gases. This type of apparatus is disclosed in Japanese Laid-Open Patent Publication No. 54131/76. In this patent publication, the fixed Venturi type carburetor comprises a main fuel supply system and a low speed fuel supply system, and the two fuel supply systems each have an air bleed and an on-off electromagnetic valve for controlling the volume of air flowing through the respective air bleed. The two electromagnetic valves are controlled in accordance with the centration of oxygen in the exhaust gases individually and independently of each other. Thus this apparatus has the disadvantage of a control circuit for the electromagnetic valves becoming complex in construction.

On the other hand, from the point of view of operation of the engine, it is not desirable to keep constant the air-fuel ratio at all engine operating conditions. More specifically, when the engine is started while it is still in cold condition, vaporization of the fuel does not take place vigorously and the fuel-air mixtures supplied in the form of a gas to the combustion engine is very lean. Therefore, it is necessary to supply to the engine a richer fuel-air mixture when the engine is started in cold condition than when it is started after being warmed up in the usual manner, to maintain the mixture in a combustible range. When the motor vehicle runs in power operating and high speed operating conditions of the engine, it is also desired that fuel-air mixtures of an air-fuel ratio lower than the theoretical air-fuel ratio be supplied to the engine. None of the air-fuel ratio control apparatus of the prior art can satisfy the aforementioned demands of the engine.

SUMMARY OF THE INVENTION

Accordingly, an object of the present invention is to provide a novel air-fuel ratio control apparatus for use in an internal combustion engine having a fixed Venturi type carburetor, wherein the concentration of one constituent of the exhaust gases from the engine is detected and control of the air-fuel ratios of the fuel-air mixtures is effected in such a manner that the ratio remains in a predetermined range in accordance with the detected value of the constituent.

Another object of the present invention is to provide an air-fuel ratio control apparatus for use in an internal combustion engine having a fixed Venturi type carburetor including a main fuel supply system and a low speed fuel supply system, wherein the main fuel supply system and the low speed fuel supply system are each provided with means for effecting control of the volume of fuel supplied to the engine, and such means are controlled by a common output signal supplied by a single control circuit which inputs the detected value of the concentration of one constituent of the exhaust gases.

Still another object of the invention is to provide an air-fuel ratio control apparatus for the type described which has particular utility in an engine provided with an exhaust emission control device using a ternary catalyst.

Still another object of the invention is to provide an air-fuel ratio control apparatus for use in an engine having a fixed Venturi type carburetor including a primary air suction conduit, a secondary air suction conduit, a low speed fuel supply system, a main fuel supply system, an engine starting system and a power system, wherein the air-fuel ratio is controlled in a manner to remain in a predetermined range by the feedback of the concentration of one constituent of the exhaust gases when the engine is operated in normal condition, and the air-fuel ratio of the fuel-air mixtures is reduced below the theoretical ratio or the fuel-air mixtures are enriched without exercising feedback of the concentration of one constituent of the exhaust gases when the engine is started, the engine is operated in power operation or the engine is operated at high speeds.

Additional and other objects and features of the invention will become apparent from the description set forth hereinafter when considered in conjunction with the accompanying drawings.

DETAILED DESCRIPTION OF THE PREFERRED EMBODIMENTS

Figure 1:
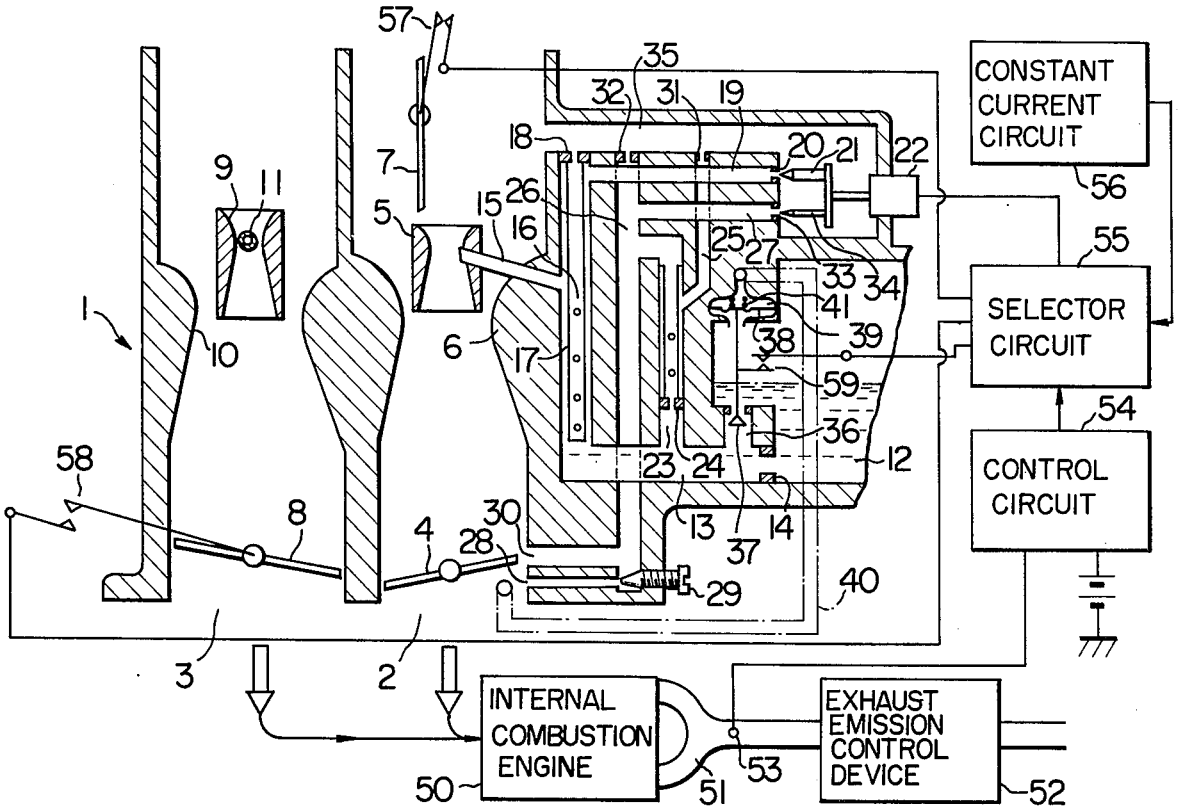
FIG. 1 is a schematic view of the air-fuel ratio control apparatus comprising one embodiment of the invention.
Figure 2:
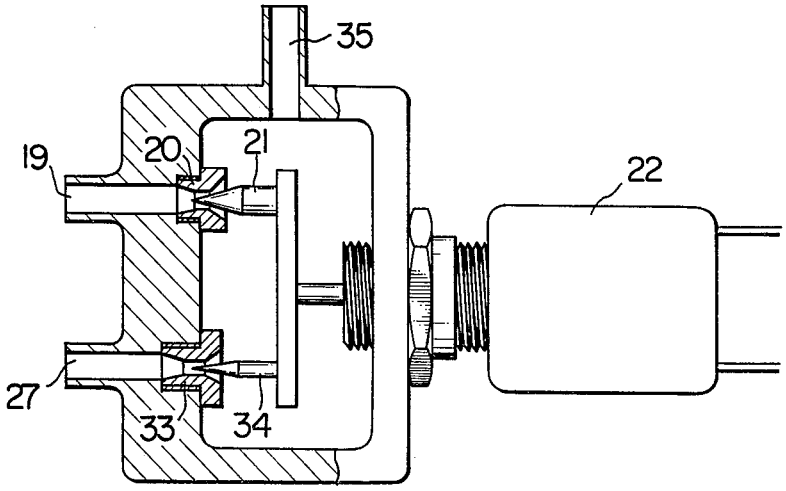
FIG. 2 is a sectional side view showing, on an enlarged scale, a portion of the apparatus shown in FIG. 1.

Referring to FIG. 1, the reference numeral 1 generally designates a fixed Venturi type caburetor of the double conduit system which is connected to an internal combustion engine 50 including an exhaust passage 51 mounting therein a conventional exhaust emission control device 52 using a ternary catalyst.

The carburetor 1 includes a primary air suction conduit 2 which operates over the range of entire operating speeds of the engine 50 to which it is connected, and a secondary air suction conduit 3 which operates only when the engine operates at high engine speeds. Mounted in the primary air suction conduit 2 are a throttle valve 4 adapted to be actuated by the driver, a minor Venturi 5, a major Venturi 6 for amplifying the negative pressure in the minor Venturi 5, and a choke valve 7. Meanwhile the secondary air suction conduit 3 has mounted therein a throttle valve 8, a minor Venturi 9, a major Venturi 10 and a fuel nozzle 11. The throttle valve 8 in the secondary air suction conduit 8 is normally biased by a spring into the closed position as shown and adapted to be brought to an open position by the negative pressure introduced into the engine 50 when the latter operates at high speeds.

A fuel supply system for the primary air suction conduit 2 comprises a float chamber 12, a main fuel supply system for supplying the fuel in the float chamber 12 to the minor Venturi 5, and a low speed fuel supply system for supplying the fuel in the float chamber 12 to the vicinity of the throttle valve 4. The main fuel supply system includes a main fuel supply passage 13 communicating with the float chamber 12, a main fuel jet 14 in the main fuel passage 13, a main nozzle 15 communicating with the passage 13, a main air bleed 16 which includes an air mixing pipe 17 and an orifice 18 for metering the air passing through the air bleed 16, and a control air bleed 19. The control air bleed 19 has affixed to its forward end an orifice 20 through which extends a needle valve 21 having a tapering portion. The needle valve 21 is supported at its rearward end by a linear electromagnet 22 and adapted to move axially thereof so as to vary the area between the orifice 20 and the needle valve 21.

Figure 3:
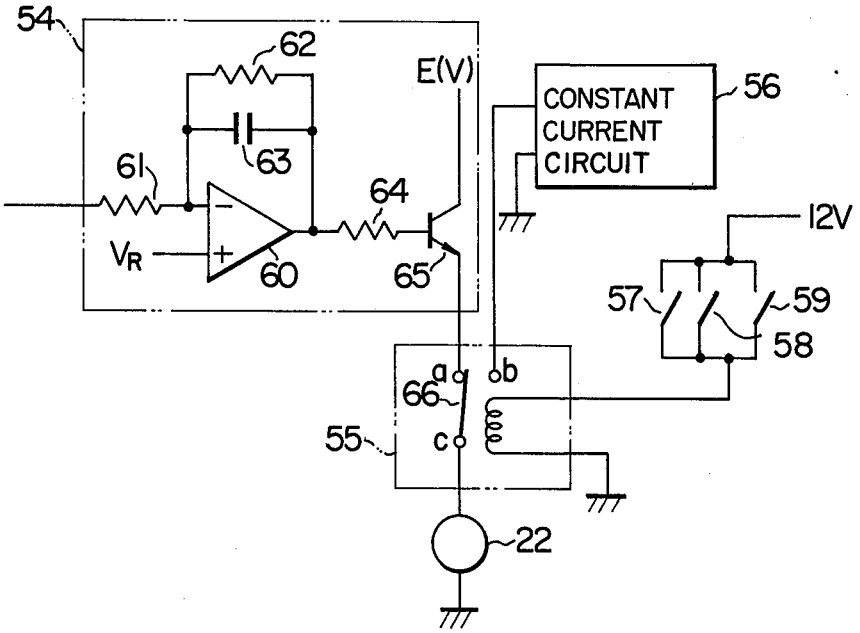
FIG. 3 is a diagram showing one example of the electric circuit of the apparatus shown in FIG. 1.

On the other hand, the low speed fuel supply system includes a passage 23 branching from the main fuel passage 13, a low speed fuel jet 24 mounted in the passage 23, a low speed auxiliary air bleed 25 and a low speed air bleed 26 and a control low speed air bleed 27 all communicating with the passage 13, an idle hole 28 opening downstream of the throttle valve 4 in its closed position, an adjusting screw 29 for adjusting the volume of fuel flowing from the idle hole 28, and a bypass hole 30 having the area of its opening controlled by the throttle valve 4. The air bleeds 25 and 26 have mounted therein fixed orifices 31 and 32 respectively for metering the volumes of air flowing therethrough, while the control low speed air bleed 27 is provided with an orifice 33 and a needle valve 34 having a tapering portion adapted to extend through the orifice 33. The orifice 20 of the main fuel supply system and the orifice 33 of the low speed fuel supply system are disposed near and parallel to each other as shown in FIG. 3, and the needle valves 21 and 34 are supported by the common electromagnet 22. The air bleeds all communicate with an air passage 35 communicating with the primary air suction conduit 2. As is well known, the volume of air passing through each of the air bleeds has an important bearing on the volume of fuel supplied to the engine 50. Thus, by effecting control of the volumes of air flowing through the control air bleeds 19 and 27 by actuating the needle valves 21 and 34 respectively, it is possible to effect control of the air-fuel ratio of the fuel-air mixtures supplied to the engine 50. Setting of a range of values to which the air-fuel ratio can be restricted by means of the needle valves 21 and 34 is a very important matter which is subsequently to be described.

The carburetor further comprises a power system including a passage 36 connecting the float chamber 12 with the main fuel passage 13, a power valve 37 for opening or closing the passage 36, a diaphragm 38 connected to the power valve 37, a diaphragm chamber 39 disposed above the diaphragm 38, a negative pressure passage 40 for communicating the diaphragm chamber 39 with the downstream side of the throttle valve 4, and a coil spring 41 mounted in the diaphragm chamber for downwardly biasing the diaphragm 38. The power system functions such that when the engine 50 is required to develop high power or when the negative pressure introduced into the engine is reduced to an inordinately low level, the power valve 37 is moved to an open position to thereby increase the volume of fuel drawn to the main fuel passage 13, so as to enrich the fuel-air mixture supplied to the engine 50.

A control system for the linear electromagnet 22 will now be described. The control system includes an oxygen concentration detector 53 mounted on the upstream side of the exhaust emission control device 52 in the exhaust passage 51, and a control circuit 54 which inputs a signal from the detector 53 and outputs a control signal or control current for controlling the linear electromagnet 22. The output of the control circuit 54 is supplied through a selector circuit 55 to the linear electromagnet 22. The selector circuit 55 also has connected thereto a constant current circuit 56 which outputs a constant control current to hold the linear electromagnet 22 in a predetermined position. The selector circuit 55 functions to select one of signals from the control circuit 54 and the constant current circuit 56 and transmits same to the linear electromagnet 22.

In order to effect control of the selector circuit 55, three microswitches 57, 58 and 59 are combined with the choke valve 7, secondary throttle valve 8 and power valve 37, respectively, and connected to the selector circuit 55. Microswitch 57 is operative to be brought to a closed position when the choke valve 7 is displaced slightly toward a closed position from its normally open position. Thus when the engine is started while still in cold condition, closing of the choke valve 7 brings microswitch 57 to a closed position, with the result that the operation of the engine in cold condition is detected by microswitch 57. Microswitch 58 is operative to be brought to a closed position when the secondary throttle valve 8 in the air suction conduit 3 is opened to a greater degree than the level for which it is set. Since the throttle valve 8 opens only when the engine operates at high speeds, microswitch 58 detects whether or not the engine is in a high speed operating range. Microswitch 59 is operative to be closed when the power valve 37 is opened. Thus microswitch 59 detects that the power valve 37 is turned on or the engine is operating in power operating condition.

FIG. 3 shows, in a simplified form, one concrete example of the control system for the linear electromagnet 22. As shown, an operation amplifier 60 inputs the output of the $O_2$ sensor 53 through a resistor 61. The operation amplifier 60 also inputs a set value V. The operation amplifier 60, resistor 61 and a capacitor 63 produce an output of a value which is proportional to the integral of the difference between the output of the $O_2$ sensor 53 and the set value V. This output is supplied to the base of a transistor 65 through a resistor 64 so as to control the emitter current of transistor 65. The emitter current is transmitted, through a relay switch 66 of the selector circuit 55, to the linear electromagnet 22 so as to control the positions of movable members of the linear electromagnet 22 and hence the positions of the needle valves 21 and 34. The relay switch 66 has fixed contacts a and b and a movable contact c, the output of the control circuit 54 being supplied to the fixed contact a while the output of the constant current circuit 56 being supplied to fixed contact b. A coil for moving the movable contact c has connected in series therewith a circuit in which the microswitches 57, 58 and 59 are connected in parallel. When the microswitches are all open, the movable contact c is in contact with fixed contact a.

Operation of the apparatus constructed as aforesaid will now be described. When the engine 50 is in normal operating condition, the choke valve 7 is fully open, the secondary throttle valve 8 is closed and the power valve is closed. At this time, the microswitches 57, 58 and 59 are all open, so that the output of the control circuit 54 is transmitted to the linear electromagnet 22. Thus the concentration of $O_2$ in exhaust emissions is detected by the $O_2$ sensor 53 and the linear electromagnet 22 is controlled in accordance with the detected value of $O_2$ concentration, so as to thereby maintain the air-fuel ratio at a predetermined level.

In this case, the needle valve 34 for the low speed fuel supply system and the needle valve 21 for the main fuel supply system are moved by the common linear electromagnet 22. As is well known, the low speed fuel supply system and the main fuel supply system vary from each other in their contribution to the air-fuel ratios of the fuel-air mixtures depending on engine speed. That is, in a low engine speed region (near the idling region), the fuel supplied through the low speed fuel supply system mainly governs the air-fuel ratio. The fuel supplied through the main fuel supply system mainly governs the air-fuel ratio in an intermediate engine speed range (this range refers in the specification to a range of speeds lower than the speed at which the secondary throttle valve 8 is opened and higher than the values of the aforesaid low speed range). In order satisfactorily to control by the common electromagnet 22 the low speed fuel supply system and the main fuel supply system which vary from each other in their operating regions, the diameters of the orifices 20 and 33 are selected in this embodiment in such a manner that the air-fuel ratio region that can be controlled by the needle valves 21 and 34 in the low engine speed range and the air-fuel ratio region that can be controlled by the needle valves 21 and 34 in the intermediate engine speed range are substantially equal to each other.

Figure 4:
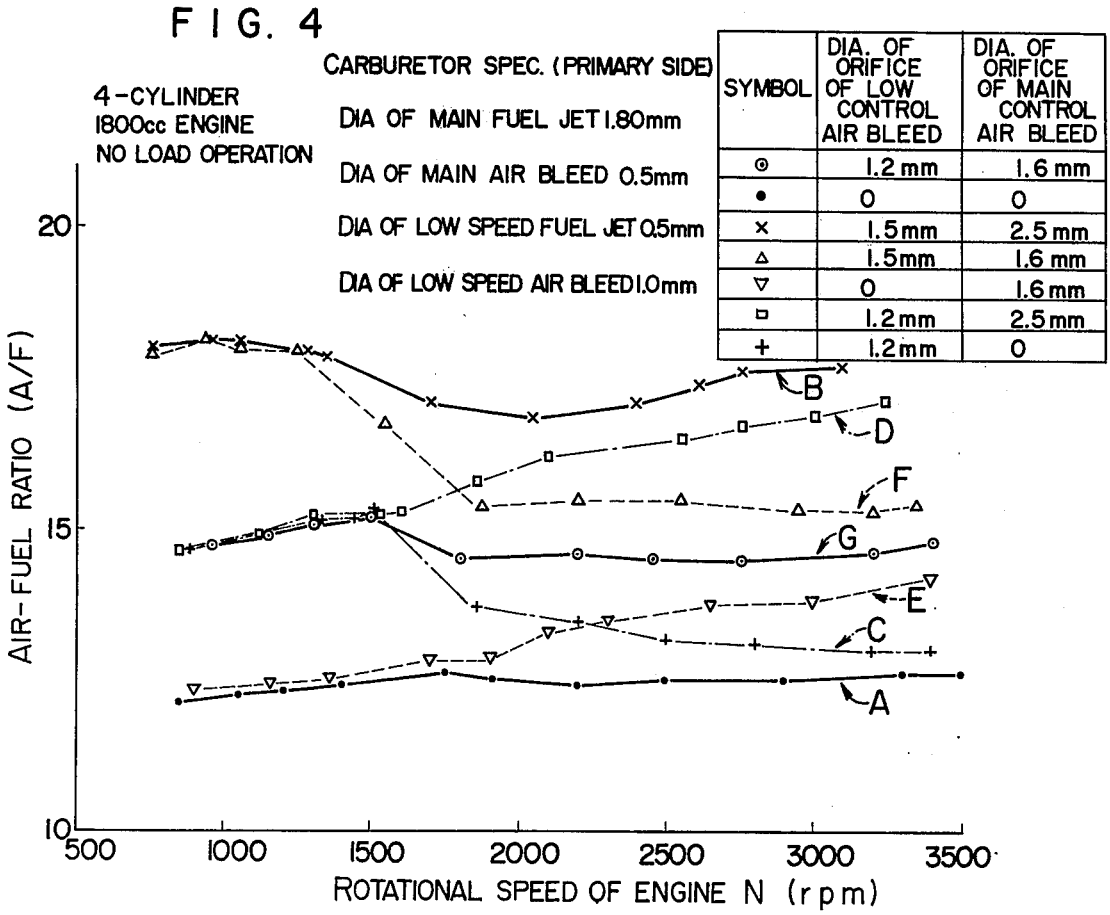
FIG. 4 is a graph showing the relation between the rotational speed of an engine and the air-fuel ratio.

FIG. 4 is a graph showing the results of experiments which show that by selecting suitable diameters for the orifices 20 and 33 of the air bleeds 19 and 27 respectively, it is possible to render the air-fuel ratio region that can be controlled in the intermediate engine speed range substantially equal to the air-fuel ratio region that can be controlled in the low engine speed range. The experiments shown in FIG. 4 were conducted by using a four-cylinder engine having a capacity of 1800 c.c. and a carburetor including a main fuel jet having a diameter 1.08 mm, a main air bleed having an orifice of a diameter 0.5 mm, a low speed fuel jet having a diameter 0.5 mm, and a low speed air bleed having an orifice of a diameter 1.0 mm. In FIG. 4, a curve A shows air-fuel ratio engine R.P.M. characteristics obtained when the diameters of orifices 20 and 33 were zero or when the air bleeds 19 and 27 were closed. Thus the curve A represents a lowermost limit (limit on the rich mixture side) of the region in which the air-fuel ratio can be controlled by means of the air bleeds 19 and 27. A curve B shows air-fuel ratio engine R.P.M. characteristics obtained when the diameter of orifice 20 was set at 2.5 mm and the diameter of orifice 33 set at 1.5 mm and the two orifices 20 and 33 were fully open. Thus the curve B represents a highermost limit (limit on the lean mixture side) of the region in which the air-fuel ratio can be controlled when the orifices 20 of a diameter of 2.5 mm and the orifice 33 of a diameter of 1.5 mm were used. Stated differentialy, if the orifices 20 and 33 having diameters of 2.5 mm and 1.5 mm respectively are used and the area of openings of these orifices are controlled by the needle valves 21 and 34 respectively, then it is possible to obtain the air-fuel ratios in the region bounded by the curves A and B. As can be clearly seen in FIG. 4, the air-fuel ratio region that can be controlled or the region bounded by the curves A and B is substantially shared by the low engine speed range and the intermediate engine speed range.

In FIG. 4, curves C and D represent characteristics obtained when the orifice 33 of the air bleed 27 of the low speed fuel supply system had a diameter 1.2 mm and the orifice 20 of the main fuel supply system had diameters zero and 2.5 mm. Stated differently, the curves C and D represent a lowermost limit and an uppermost limit respectively of the region of the air-fuel ratios that could be controlled when the air bleed of the low speed fuel supply system was kept constant and only the air bleed of the main fuel supply system was controlled. Curves E and F represent characteristics obtained when the orifice 20 of the air bleed 19 had a diameter 1.6 mm and the orifice 33 of the low speed fuel supply system had diameters zero and 1.5 mm. Stated differently, the curves E and F represent a lowermost limit and an uppermost limit respectively of the region of the air-fuel ratios that could be controlled when the diameter of the orifice of the air bleed of the main fuel supply system was kept constant and only the orifice of the air bleed of the low speed fuel supply system was controlled. A curve G represents characteristics obtained when the orifice 33 of the air bleed 37 of the low speed fuel supply system had a diameter 1.2 mm and the orifice 20 of the air bleed 19 of the main fuel supply system had a diameter 1.6 mm. It will be seen that the curve G shows that the air-fuel ratio is about 14.7 over the entire range of engine speeds. Thus it will be appreciated that the air-fuel ratio can be controlled satisfactorily in the region bounded by the curves A and B, if the orifice 33 of the low speed fuel supply system has a diameter 1.5 mm, the orifice 20 of the main fuel supply system has a diameter of 2.5 mm, the needles 21 and 34 are connected to each other such that needle 34 fully closes or opens orifice 33 simultaneously as needle 21 fully closes or opens orifice 20, and the tapering portions of the needles 21 and 34 are suitably configured.

The feature of the present invention that the region of the air-fuel ratios that can be controlled is substantially equal for the low engine speed range and the intermediate engine speed range offers great advantages in control characteristics. The advantages offered will be described in detail. If the region of the air-fuel ratios that can be controlled is substantially constant irrespective of the engine speed, it is possible to keep the air-fuel ratio substantially constant with respect to one position of each of the needle valves 21 and 34, regardless of the engine speed. Stated differently, the air-fuel ratio is determined by the position of each of the needle valves 21 and 34 and not much influenced by the engine speed. Assume that the needle valves 21 and 34 are each in a given position, so that the engine operates at low speed while the air-fuel ratio is kept at a level commensurate with the position of each of the needle valves. When the engine speed is rapidly increased from the low speed level, no appreciable change will be caused to occur in the air-fuel ratio. Thus the motor vehicle can be operated in a stable manner with the needle valves remaining in the given positions. Thus, when the air-fuel ratio control apparatus according to the invention is used, a change in engine speed causes no variation to occur in the air-fuel ratio.

However, in the event that the region of the air-fuel ratios that can be controlled for the low engine speed range differs greatly from the region of the air-fuel ratios that can be controlled for the intermediate engine speed range, the air-fuel ratio for the low engine speed range will differ from the air-fuel ratio for the intermediate engine speed range with respect to a given position of each of the needle valves 21 and 34. Accordingly, even if the air-fuel ratio is controlled to a predetermined level in the low engine speed range and the needle valves 21 and 34 are each in a position commensurate with the prevailing air-fuel ratio, it will be required to change the positions of the needle valves 21 and 34 to bring the air-fuel ratio to a predetermined level, in case the engine speed is increased. Since the needle valves 21 and 34 are subjected to feedback control by means of the linear electromagnet 22, it is possible to change the position of the needle valves 21 and 34 to bring the air-fuel ratio to the desired level. However, a time lag occurring in the control system will cause a lapse of time before the needle valves 21 and 34 each move to a predetermined position. During this period of time, the air-fuel ratio does not have a predetermined value. Thus changes in engine speed cause variations in air-fuel ratio. However, no variations in air-fuel ratio occur if the air-fuel ratio control apparatus according to the invention is used.

When the engine is started while it is still cold, the choke valve 7 is closed to increase the negative pressure in the Venturi so as to thereby increase the flow of fuel. Closing the choke valve 7 brings microswitch 57 to its closed position, thereby causing the movable contact c of the relay switch 66 to be released from contact with fixed contact a and brought into contact with fixed contact b. This disconnects the control circuit 54 from the linear electromagnet 22, so that a constant current is supplied from the constant current circuit 56 to the linear electromagnet 22, to keep the needle valves 21 and 34 each in a predetermined position. Thus the linear electromagnet 22 is not subjected to feedback control, and an enriched fuel-air mixture required for starting the engine in cold engine condition is supplied to the engine. Likewise, in the engine high speed operating range, the microswitch 58 combined with the secondary throttle valve 8 is closed as the throttle valve 8 opens. This disconnects the linear electromagnet 22 from the control circuit 54 and connects the same with the constant current circuit 56. In the power operating range of the engine, microswitch 59 is closed upon closing of the power valve 37, so that the linear electromagnetic valve 22 is disconnected from the control circuit 54 and connected with the constant current circuit 56. Thus the linear electromagnet 22 is not subjected to feedback control in both the engine high speed operating range and the engine power operating range, thereby enabling a required enriched fuel-air mixture to be supplied to the engine.

Figure 5:
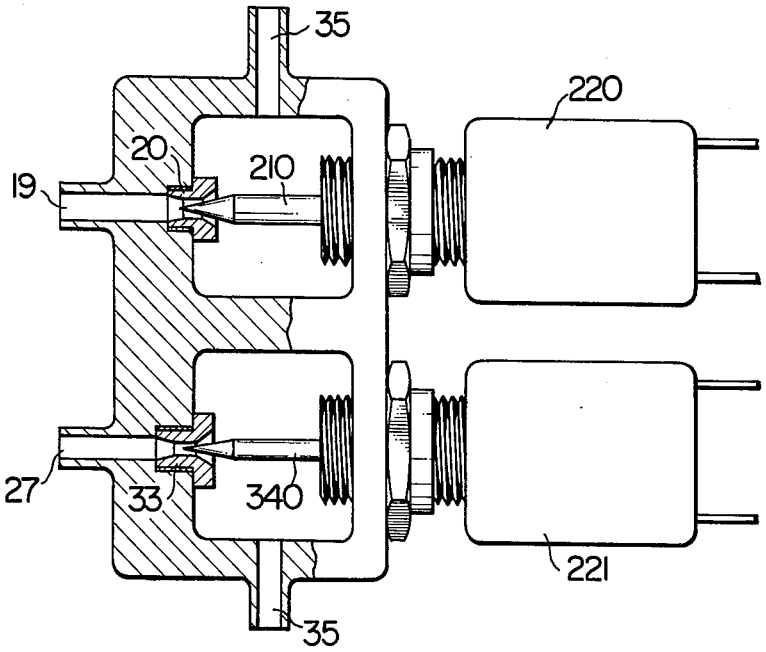
FIG. 5 is a sectional side view of the same portion that is shown in FIG. 2 but showing the portion of a modification of the embodiment shown in FIG. 1.

FIG. 5 shows a portion of a modification of the embodiment shown in FIG. 1. In this modification of the embodiment, the needle valves 210 and 340 for opening and closing the orifices 20 and 34 of the control air bleeds 19 and 27 and connected to separate linear electromagnets 220 and 221, respectively, which are electrically connected in series with each other so that the same control current will flow thereto from the control circuit 54 or constant current circuit 56. In this embodiment also, the linear electromagnets are simultaneously controlled by a control current from the control circuit 54 to move the needle valves 210 and 340 simultaneously so as to effect control of the air-fuel ratio, when the engine operates in normal operating condition. When the needle valves 210 and 340 are supported by the respective linear electromagnets 220 and 221 as in this embodiment, it is possible to vary the stroke of the needle valves by using electromagnets of different strokes. Thus, in this embodiment, the needle valve 210 associated with the orifice 20 of a larger diameter can have a stroke which is greater than the stroke of the needle valve 340 associated with the orifice 33 of a smaller diameter. By this arrangement, it is possible to increase the degree of precision with which the air-fuel ratio is controlled, by permitting the forward end portions of the needle valves 210 and 340 to taper at the same angle.

Figure 6:
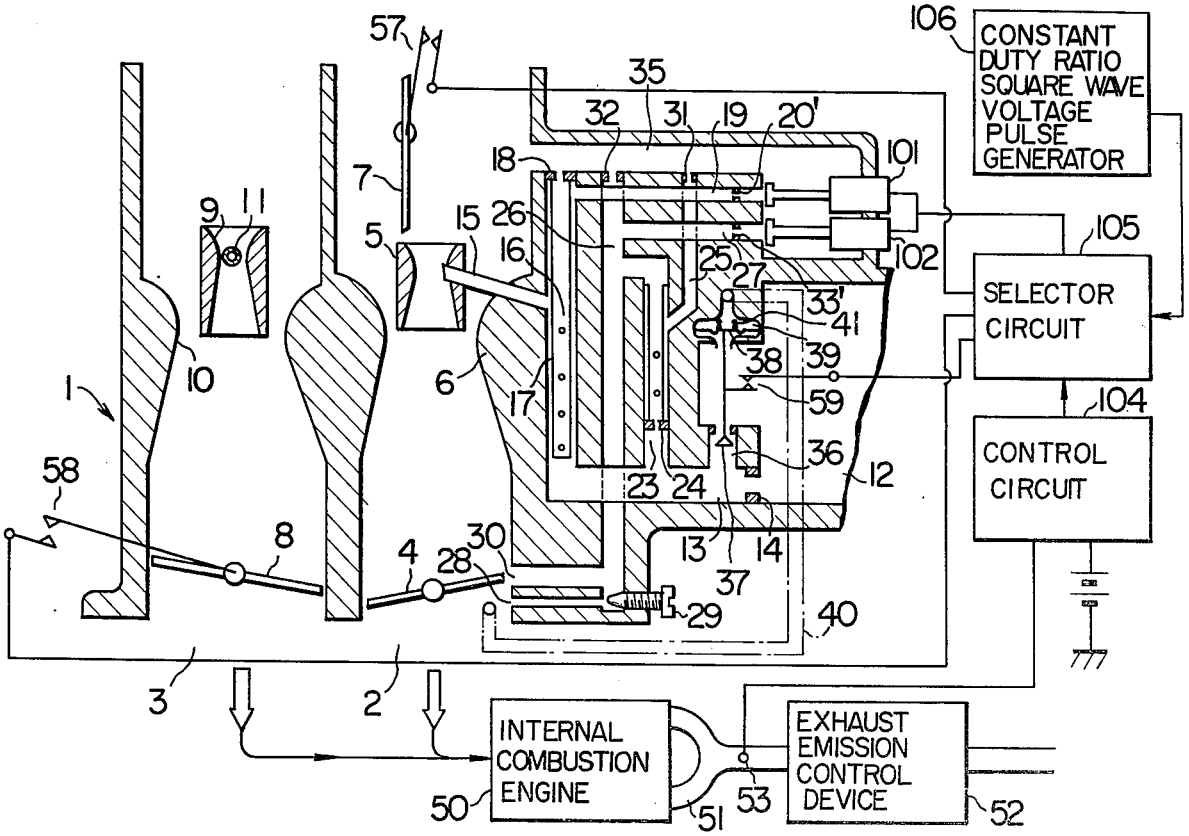
FIG. 6 is a schematic view of still another embodiment of the apparatus shown in FIG. 1.
Figure 7:
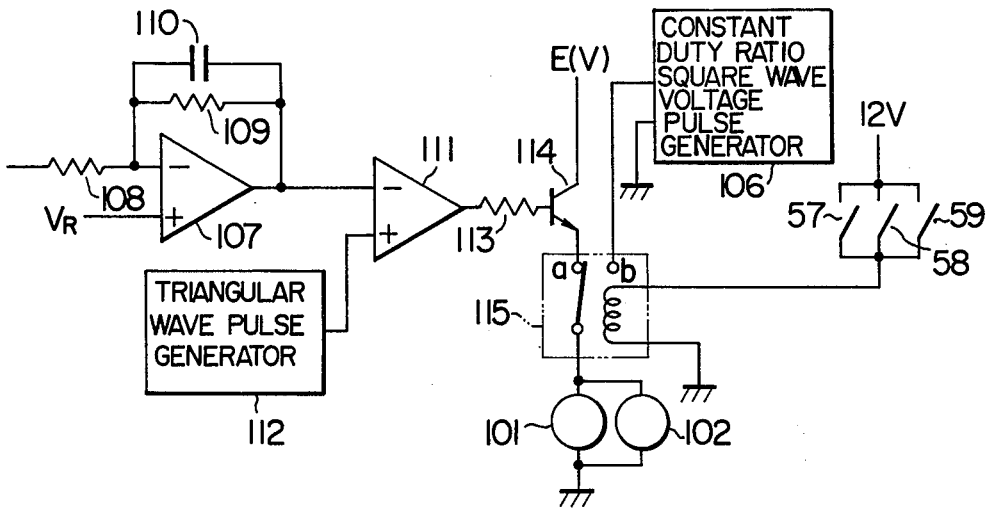
FIG. 7 is a diagram showing one example of the electric circuit of the apparatus shown in FIG. 6.
Figure 8:
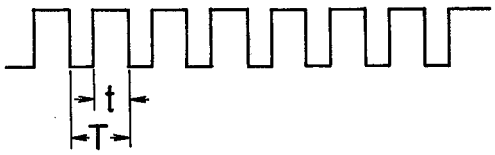
FIG. 8 is a view showing voltage pulses of the square wave form applied to the electromagnetic valves of the apparatus shown in FIG. 6.

In the two embodiments shown in FIGS. 1 and 5, the needle valves and at least one linear electromagnet for driving the former are used for effecting control of the volume of air passing through each air bleed. FIG. 6 shows an embodiment wherein on-off electromagnetic valves are used in place of the needle valves and at least one linear electromagnet. More specifically, a metering orifice 20' is mounted in the control air bleed 19 of the main fuel supply system, and an on-off electromagnetic valve 101 is located in spaced juxtaposed relation to the forward end of the air bleed 19. A metering orifice 33' is mounted in the control air bleed 27 of the low speed fuel supply system, and another on-off electromagnetic valve 102 is located in spaced juxtaposed relation to the foward end of the air bleed 27. The on-off electromagnetic valves 101 and 102 are of the well-known type which intermittently turns on and off the air bleeds 19 and 27 as voltage pulses of the square wave form are impressed thereon. The voltage pulses of the square wave form impressed on the electromagnetic valves 101 and 102 have, as shown in FIG. 8, a constant period T, and the period of time during which the electromagnetic valves are open depends on the duration t of each pulse. Thus, by controlling the ratio of the duration t to the period T (hereinafter referred to as a duty ratio), it is possible to effect control of the volumes of air passing through the air bleeds 19 and 27 so as to thereby control the air-fuel ratio. In this embodiment also, the diameters of the orifices 20' and 33' are determined in such a manner that the region of the air-fuel ratios for the low engine speed range that can be controlled by the on-off electromagnetic valves 101 and 102 is substantially equal to the region of the air-fuel ratios for the intermediate engine speed range that can be controlled thereby. A control circuit 104, a constant duty ratio square wave voltage pulse generator 106 and a selector circuit 105 are provided for controlling the duty ratio of the voltage pulses of the square wave form supplied to the electromagnetic valves 101 and 102, and the control circuit 104 inputs the output of the $O_2$ sensor 53. These circuits are shown in detail in FIG. 7 wherein an operation amplifier 107 inputs the output of the $O_2$ sensor 53, and a value proportional to the integral of the difference between the output of the $O_2$ sensor 53 and the set value $V_R$ is produced by the operation amplifier 107, resistors 108 and 109 and a capacitor 110. The comparator 111 inputs both this value and the output of a triangular wave pulse generator 112. Thus the comparator 111 produces an output of a square wave form having a duty ratio which is proportional to the difference between the set value $V_R$ and the output of the $O_2$ sensor 53. The output of the comparator 111 is transmitted to the base of a transistor 114 for amplification through a resistor 113 and transmitted from the transistor 114 to the electromagnetic valves 101 and 102 through a relay switch 115. Like the relay switch 66 of the embodiment shown in FIGS. 1 and 3, the relay switch 115 is controlled by microswitches 57, 58 and 59 and connects the electromagnetic valves 101 and 102 with the constant duty ratio square wave voltage pulse generator 106 upon closing of any one of the microswitches 57, 58 and 59. Other parts are similar in construction to the embodiment shown in FIG. 1, so that their explanation will be omitted.

In this embodiment also, feedback control of the air-fuel ratio is effected when the engine is operating in normal operating condition or when all the microswitches 57, 58 and 59 are open. More specifically, the concentration of $O_2$ in the exhaust emissions is detected, and voltage pulses of the square wave form of a duty ratio commensurate with the detected value of $O_2$ concentration is simultaneously applied to the on-off electromagnetic valves 101 and 102, so as to thereby control the air-fuel ratio. The control air bleed for the main fuel supply system and the control air bleed for the low speed fuel supply system each has mounted therein an orifice which is dimensioned such that the region of the air-fuel ratios that can be controlled for the low engine speed range is substantialy equal to the region of the air-fuel ratios that can be controlled for the intermediate engine speed range. Thus, by simultaneously controlling the on-off electromagnetic valves 101 and 102 for the two systems by the same voltage pulses of the square wave form, it is possible to effect control of the air-fuel ratio satisfactorily. It is to be understood that in place of using the two electromagnetic valves 101 and 102, one electromagnetic valves may be used for simultaneously opening and closing the control air bleeds 19 and 27 of the two systems.

The microswitches 57, 58 and 59 are closed when the engine is started in the cold engine condition, the engine is operated at high speeds and the engine operated in power operating condition, so that the electromagnetic valves 101 and 102 are disconnected from the control circuit 104 and connected with the constant duty ratio square wave voltage pulse generator circuit 106. Thus the electromagnetic valves 101 and 102 are not subjected to feedback control, thereby permitting desired rich fuel-air mixtures to be supplied to the engine to start or operate the same.

Figure 9:
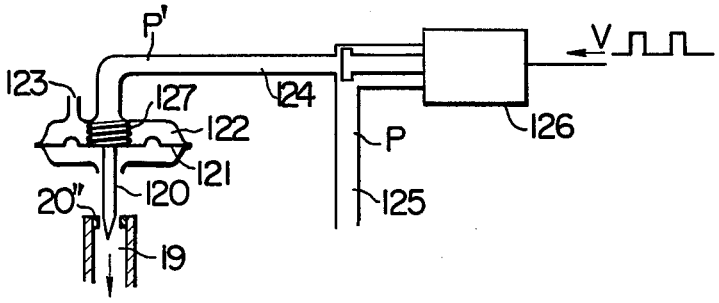
FIG. 9 is a schematic view showing a portion of a further embodiment of the apparatus shown in FIG. 1.
Figure 10:
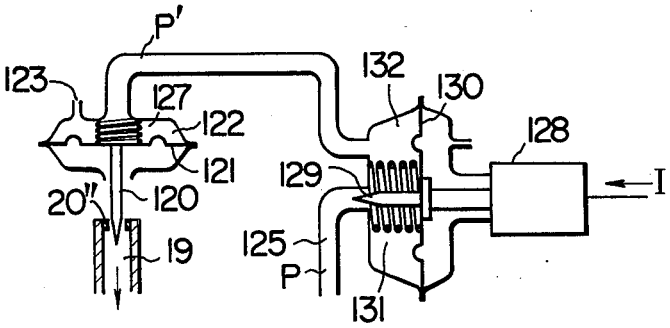
FIG. 10 is a schematic view showing a portion of a still further embodiment of the apparatus shown in FIG. 1.

In the embodiments shown and described hereinabove, the volumes of air passing through the control air bleeds are directly controlled by at least one linear electromagnet or on-off electromagnetic valves. It is to be understood that the invention is not limited to these specific forms of the embodiments and that it is possible according to the invention to indirectly control the control air bleeds by means of at least one linear electromagnet or on-off electromagnetic valves. FIG. 9 and FIG. 10 show portions of embodiments in which on-off electromagnetic valves and linear electromagnets are used respectively, for indirectly controlling the air bleeds. In each of these figures, there is only shown a control mechanism for the control air bleed of the main fuel supply system. Referring to FIG. 9, the control air bleed for the main fuel supply system has secured to its entrance an orifice 20'' through which extends a needle valve 120 firmly secured to a diaphragm 121. The diaphragm 121 includes a lower surface which is exposed to atmosphere and an upper surface on which acts the negative pressure in a negative pressure chamber 122. The negative pressure chamber 122 communicates with atmosphere through a throttle 123 and with a suitable negative pressure source (not shown) through passages 124 and 125. An on-off electromagnetic valve 126 is mounted between the passages 124 and 125. In the figure, the numeral 127 refers to a return spring. Although not shown, the low speed fuel supply system has a control mechanism similar to the one shown and described with reference to the main fuel supply system. Voltage pulses of the square wave form which have their duty ratio controlled are applied to the on-off electromagnetic valves of the main fuel supply system and low speed fuel supply system in the same manner as shown in FIG. 7, so as to thereby effect control of the negative pressure P' in the negative pressure chamber 122. Since the needle valve 120 moves to a position which is commensurate with the negative pressure P' in the negative pressure chamber, it is possible to control the area of opening of the orifice 20" by controlling the negative pressure P' in the negative pressure chamber 122, thereby making it possible to control the volume of air passing through the air bleed 19. In this embodiment also, the diameters of the orifices, configuration of the needle valves and the strokes of the needle valves are determined in such a manner that the region of the air-fuel ratios that can be controlled by the on-off electromagnetic valves for the low engine speed range is substantially equal to the region of the air-fuel ratios that can be controlled thereby for the intermediate engine speed range. This embodiment has an advantage that the use of the on-off electromagnetic valves does not cause the air passing through the control air bleeds to flow in pulsating currents. However, this embodiment raises the problem of the position of the needle valve 120 undergoing a change upon variation of the negative pressure in the passage 125.

FIG. 10 shows an embodiment in which a portion of the embodiment shown in FIG. 9 is modified. In this embodiment, there is provided a negative pressure control mechanism including a linear electromagnet 128, in place of the on-off electromagnetic valve 126, between the passages 124 and 125. The negative pressure control mechanism further comprises a needle valve 129, a diaphragm 130 supporting the needle valve 129, a return spring 131, and a negative pressure chamber 132 communicating with the passages 124 and 125. The needle valve 129 is connected to the linear electromagnetic valve 128 and arranged in a manner to change the area of opening of the passage 125. In this embodiment, a negative pressure P' which has nothing to do with the negative pressure in the passage 125 and which is commensurate with the value of a current passing through the linear electromagnet 128 is produced in the negative pressure chamber 132, so that the negative pressure P' controls the position of the needle valve 120 and the volume of air passing through the air bleed 19 is controlled.

In all the embodiments shown and described hereinabove, the flow of the fuel to the engine is controlled by controlling the volumes of air passing through the air bleeds of the main fuel supply system and low speed fuel supply system. It is to be understood, however, that according to the invention it is possible to directly effect control of the volumes of fuel flowing through the fuel passages of the respective systems.

We claim:

1. An air-fuel ratio control apparatus for use in an internal combustion engine having a fixed Venturi type carburetor, an exhaust conduit and an exhaust emission control device including a ternary catalyst, said carburetor including a primary air suction conduit having mounted therein a choke valve, a primary fixed Venturi and a primary throttle valve adapted to be operated by a driver, a secondary air suction conduit having mounted therein a secondary throttle valve adapted to open when the negative pressure introduced into the engine increases, a fuel bowl, a main fuel supply passage for supplying fuel from said fuel bowl into the air in said primary fixed Venturi, a low speed fuel supply passage for supplying fuel from said fuel bowl in the air in the vicinity of said primary throttle valve, and a power valve for increasing the volume of fuel supplied to said main fuel supply passage from said fuel bowl when the negative pressure introduced into the engine decreases, said air-fuel ratio control apparatus comprising:

means provided in said exhaust conduit for detecting the concentration of one constituent of exhaust emissions;

first fuel control means for effecting control of the rate of fuel flowing through said main fuel supply passage;

second fuel control means for effecting control of the rate of fuel flowing through said low speed fuel supply passage; and electric circuit means which inputs a signal from said detecting means and outputs a common signal for controlling said first and second fuel control means;

said first fuel control means and said second fuel control means being constructed in such a manner the region of the air-fuel ratios can be controlled thereby for the low engine speed range is substantially equal to the region of the air-fuel ratios that can be controlled thereby for the intermediate engine speed range, further comprising:

first switch means combined with said choke valve for detecting the movement of the choke valve toward a closed position in an amount which is greater than a predetermined value;

second switch means combined with said secondary throttle valve for detecting the movement of the secondary throttle toward an open position in an amount which is greater than a predetermined value;

third switch means combined with said power valve for detecting the movement of the power valve toward an open position in an amount which is greater than a predetermined value; and means for maintaining each of said first fuel control means and said second fuel control means in a predetermined condition when at least one of said first, second and third switch means is turned on.

2. An air-fuel ratio control apparatus for use in an internal combustion engine having a fixed Venturi type carburetor, an exhaust conduit and an exhaust emission control device including a ternary catalyst, said carburetor including a primary air suction conduit having mounted therein a choke valve, a primary fixed Venturi and a primary throttle valve adapted to be operated by a driver, a secondary air suction conduit having mounted therein a secondary throttle valve adapted to open when the negative pressure introduced into the engine increases, a fuel bowl, a main fuel supply passage for supplying fuel from said fuel bowl into the air in said primary fixed Venturi, a low speed fuel supply passage for supplying fuel from said fuel bowl into the air in the vicinity of said primary throttle valve, and a power valve for increasing the volume of fuel supplied to said main fuel supply passage from said fuel bowl when the negative pressure introduced into the engine decreases, said air-fuel ratio control apparatus comprising:

means provided in said exhaust conduit for detecting the concentration of one constituent of exhaust emissions;

first fuel control means for effecting control of the rate of fuel flowing through said main fuel supply passage;

second fuel control means for effecting control of the rate of fuel flowing through said low speed fuel supply passage; and electric circuit means which inputs a signal from said detecting means and outputs a common signal for controlling said first and second fuel control means;

said first fuel control means and said second fuel control means being constructed in such a manner that the region of the air-fuel ratios that can be controlled thereby for the low engine speed range is substantially equal to the region of the air-fuel ratios that can be controlled thereby for the intermediate engine speed range, wherein said first fuel control means comprises an air passage communicating with said main fuel supply passage, and a first electromagnetic valve for controlling the flow rate of air passing through said air passage, and said second fuel control means comprises an air passage communicating with said low speed fuel supply passage, and a second electromagnetic valve for controlling the flow rate of air passing through said air passage, wherein said first electromagnetic valve and said second electromagnetic valve each comprise an on-off electromagnetic valve for opening and closing the respective air passage, and wherein said electric circuit means comprises a control circuit which outputs to each of said electromagnetic valves voltage pulses of a square wave form having a duty ratio consistent with a signal from said detecting means, further comprising:

first switch means combined with said choke valve for detecting the movement of the choke valve toward a closed position in an amount which is greater than a predetermined value;

second switch means combined with said secondary throttle valve for detecting the movement of the secondary throttle valve toward an open position in an amount which is greater than a predetermined value; and third switch means combined with said power valve for detecting the movement of the power valve toward an open position in an amount which is greater than a predetermined value; and wherein said electric circuit means further comprises:

a circuit which outputs voltage pulses of a swuare wave form having a predetermined duty ratio; and a selector circuit for selectively connecting one of said constant duty ratio square wave voltage pulse generating circuit and said control circuit with each of said electromagnets;

said selector circuit being connected to said switch means in a manner to connect said control means with said electromagnets when said switch means all remain inoperative and to connect said constant duty ratio square wave voltage pulse generating circuit with said electromagnets when at least one of said switch means is rendered operative.

3. An air-fuel ratio control apparatus for use in an internal combustion engine having a fixed Venturi type carburetor and an exhaust conduit, said carburetor including an air suction conduit, a throttle valve, a fixed Venturi, a fuel bowl, a main fuel supply passage for supplying fuel from said fuel bowl into the air in the fixed Venturi, and a low speed fuel supply passage for supplying fuel from said fuel bowl into the air in the vicinity of said throttle valve, said air-fuel ratio control apparatus comprising:

detector means provided in said exhaust conduit for detecting the concentration of one constituent of exhaust emissions;

first fuel control means for effecting control of the flow rate of the fuel through said main fuel supply passage;

second fuel control means for effecting control of the flow rate of the fuel through said low speed fuel supply passage;

switch means for detecting the condition of operation of said carburetor; and electric circuit means which inputs an output signal from said detector means and an output signal from said switch means and which outputs one of a square wave form signal having a duty ratio which is a function of the output signal from said detector means and a square wave form signal having a constant duty ratio, which is arbitrarily selected with regard to said detector means, to said first fuel control means and said second fuel control means depending on said output signal from said switch means.

4. An air-fuel ratio control apparatus as set forth in claim 3, wherein said first fuel control means comprises an air passage communicating with said main fuel supply passage, and a first electromagnetic valve for controlling the flow rate of air passing through said air passage, and said second fuel control means comprises an air passage communicating with said low speed fuel supply passage, and a second electromagnetic valve for controlling the flow rate of air passing through said air passage.

5. An air-fuel ratio control apparatus as set forth in claim 3, wherein said first fuel control means comprises an air passage communicating with said main fuel supply passage, an orifice secured in said air passage, a needle valve extending through said orifice, and a first linear electromagnet for moving said needle valve axially thereof, said electromagnet being operative to move said needle valve to a position commensurate with the value of a current passed thereto, and said second fuel control means comprises an air passage communicating with said low speed fuel supply passage, an orifice secured in said air passage, a needle valve extending through said orifice, and a second linear electromagnet for moving said needle valve axially thereof, said electromagnet being operative to move said needle valve to a position commensurate with the value of a current passed thereto, and wherein said electric circuit means comprises a control circuit which outputs to each of said linear electromagnets a current of a value consistent with a signal from said detecting means.

6. An air-fuel ratio control apparatus as set forth in claim 5, wherein said first electromagnet and said second electromagnet are formed as a common linear electromagnet.

7. An air-fuel ratio control apparatus as set forth in claim 4, wherein said first electromagnetic valve and said second electromagnetic valve each comprise an on-off electromagnetic valve for opening and closing the respective air passage, and wherein said electric circuit means comprises a control circuit for supplying to each of said electromagnetic valves voltage pulses of a square wave form having a duty ratio consisting with a signal from said detecting means.

8. An air-fuel ratio control apparatus for use in an internal combustion engine having a fixed Venturi type carburetor, an exhaust conduit, and an exhaust emission control device including a ternary catalyst, said carburetor including a primary air suction conduit having mounted therein a choke valve, a primary fixed Venturi and a primary throttle valve adapted to be operated by a driver, a fuel bowl, a primary main fuel passage for supplying fuel from said fuel bowl into the air in said fixed Venturi, a primary low speed fuel passage for supplying fuel from said fuel bowl into the air in the vicinity of said primary throttle valve, a secondary air suction conduit having mounted therein a secondary fixed Venturi and a secondary throttle valve adapted to open when the negative pressure introduced into the engine increases, a secondary main fuel passage for supplying fuel from said fuel bowl into the air in said secondary fixed Venturi, a secondary low speed fuel passage for supplying fuel from said fuel bowl into the air in the vicinity of said secondary throttle valve, and a power valve for increasing the volume of fuel supplied from said fuel bowl to said primary main fuel passage when the negative pressure introduced into the engine decreases, said air-fuel ratio control apparatus comprising:

detector means provided in said exhaust conduit for detecting the concentration of one consituent of exhaust emissions;

first fuel control means for effecting control of the flow rate of the fuel through said primary main fuel passage;

second fuel control means for effecting control of the flow rate of the fuel through said primary low speed fuel passage;

switch means for detecting whether or not the displacement of a movable member has reached a predetermined value, the displacement of said movable member varying depending on the condition of operation of said carburetor; and electric circuit means which inputs an output signal from said detector means and an output signal from said switch means and which outputs, to said first fuel control means and said second fuel control means, a square wave form signal having a duty ratio consistent with the output signal from said detector means when the output signal from said switch means is below a predetermined value and a swuare wave form signal having a constant duty ratio, which is arbitrarily selected with respect to the output signal from said detector means, when the output signal from said switch means has reached said predetermined value.

9. An air-fuel ratio control apparatus as set forth in claim 8, wherein said first fuel control means comprises an air passage communicating with said main fuel supply passage, and a first electromagnetic valve for controlling the flow rate of air passing through said air passage, and said second fuel control means comprises an air passage communicating with said low speed fuel supply passage, and a second electromagnetic valve for controlling the flow rate of air passing through said air passage.

10. An air-fuel ratio control apparatus as set forth in claim 8, wherein said first fuel control means comprises an air passage communicating with said main fuel supply passage, an orifice secured in said air passage, a needle valve extending through said orifice, and a first linear electromagnet for moving said needle valve axially thereof, said electromagnet being operative to move said needle valve to a position commensurate with the valve of a current passed thereto, and said second fuel control means comprises an air passage communicating with said low speed fuel supply passage, an orifice secured in said air passage, a needle valve extending through said orifice, and a second linear electromagnet for moving said needle valve axially thereof, said electromagnet being operative to move said needle valve to a position commensurate with the value of a current passed thereto, and wherein said electric circuit means comprises a control circuit supplying to each of said linear electromagnets a current of a value consistent with a signal from said detecting means.

11. An air-fuel ratio control apparatus as set forth in claim 8, wherein said first fuel control means comprises:

an air passage communicating with said main fuel supply passage;

a needle for controlling the flow rate of air passing through said air passage;

negative pressure responsive means for moving said needle to a position commensurate with the value of a negative pressure applied thereto;

passages for communicating said negative pressure responsive means with a negative pressure source; and an on-off electromagnetic valve for intermittently opening and closing said passages; wherein said second fuel control means comprises:

an air passage communicating with said low speed fuel supply passage;

a needle for controlling the flow rate of air passing through said air passage;

negative pressure responsive means for moving said needle to a position commensurate with the value of a negative pressure applied thereto;

passages for communicating said negative pressure responsive means with a negative pressure source; and an on-off electromagnetic valve for intermittently opening and closing said passages; and wherein said electric circuit means comprises a control circuit which outputs to each of said electromagnetic valves voltage pulses of a square wave form having a duty ratio consistent with a signal from said detecting means.

12. An air-fuel ratio control apparatus as set forth in claim 8, wherein said first fuel control means comprises:

an air passage communicating with said main fuel supply passage;

a needle for controlling the flow rate of air passing through said air passage;

negative pressure responsive means for moving said needle to a position commensurate with the value of a negative pressure applied thereto; and negative pressure supply means for supplying a controlled negative pressure to said negative pressure responsive means;

said negative pressure supply means comprising a diaphragm, a negative pressure chamber facing one side of said diaphragm, said negative pressure chamber being connected to said negative pressure responsive means through a first passage and to a negative pressure supply source through a second passage, a needle for controlling the area of the opening of said second passage, said needle being connected to said diaphragm, and a linear electromagnet connected to said needle; wherein said second fuel control means comprises:

an air passage communicating with said low speed fuel supply passage;

a needle for controlling the flow rate of air passing through said air passage;

negative pressure responsive means for moving said needle to a position commensurate with the value of a negative pressure applied thereto; and negative pressure supply means for supplying a controlled negative pressure to said negative pressure responsive means;

said negative pressure supply means comprising a diaphram, a negative pressure chamber facing one side of said diaphragm, said negative pressure chamber being connected to said negative pressure responsive means through a third passage and to a negative pressure supply source through a fourth passage, a needle for controlling the area of the opening of said fourth passage, said needle being connected to said diaphragm, and a linear electromagnet connected to said needle; and wherein said electric circuit means comprises a control circuit which outputs to each of said linear electromagnets a current consistent with a signal from said detecting means.

13. An air-fuel ratio control apparatus as set forth in claim 10, wherein said first electromagnet and said second electromagnet are formed as a common linear electromagnet.

14. An air-fuel ratio control apparatus as set forth in claim 10, further comprising:

first switch means combined with said choke valve for detecting the movement of the choke valve toward a closed position in an amount which is greater than a predetermined value;

second switch means combined with said secondary throttle valve for detecting the movement of the second throttle valve toward an open position in an amount which is greater than a predetermined value; and third switch means combined with said power valve for detecting the movement of the power valve toward an open position in an amount which is greater than a predetermined value; and wherein said electric circuit means further comprises:

a constant current circuit which outputs a constant current; and a selector circuit for selectively connecting one of said constant current circuit and said control circuit with said electromagnets;

said selector circuit being connected to said switch means in a manner to connect said control circuit with said electromagnets when said switch means all remain inoperative and to connect said constant current circuit with said electromagnets when at least one of said switch means is rendered operative.

15. An air-fuel ratio control apparatus as set forth in claim 7, wherein said first electromagnetic valve and said second electromagnetic valve each comprise an on-off electromagnetic valve for opening and closing the respective air passage, and wherein said electric circuit means comprises a control circuit which outputs to each of said electromagnetic valves voltage pulses of a square wave form having a duty ratio consistent with a signal from said detecting means.

* * * * *